United States Patent [19]

Yarita et al.

[11] Patent Number: 4,703,641

[45] Date of Patent: Nov. 3, 1987

[54] ROLLED PLATE SECTIONAL PROFILE CONTROL ROLLING METHOD AND ROLLING MILL

[75] Inventors: Ikuo Yarita; Masanori Kitahama; Toru Sasaki, all of Chiba, Japan

[73] Assignee: Kawasaki Steel Corporation, Kobe, Japan

[21] Appl. No.: 810,972

[22] Filed: Dec. 19, 1985

[30] Foreign Application Priority Data

Dec. 19, 1984 [JP] Japan ..... 59-266098

[51] Int. Cl.[4] ..... B21B 31/18; B21B 27/02

[52] U.S. Cl. ..... 72/247; 72/243; 72/366

[58] Field of Search ..... 72/247, 243, 241, 365, 72/366, 199

[56] References Cited

U.S. PATENT DOCUMENTS 4,519,233 5/1985 Feldmann et al. ..... 72/247

FOREIGN PATENT DOCUMENTS 0043869 1/1982 European Pat. Off. .
0086934 8/1983 European Pat. Off. .
0030013 3/1981 Japan ..... 72/241
0030014 3/1981 Japan ..... 72/247
0131002 10/1981 Japan ..... 72/247
0064103 4/1984 Japan ..... 72/247

OTHER PUBLICATIONS

Patent Abstracts of Japan, vol. 8, No. 12 (M-269), (1449), Jan. 19th, 1984 & Japan-A-58 176 002.

*Primary Examiner*—Robert L. Spruill
*Assistant Examiner*—Steve Katz
*Attorney, Agent, or Firm*—Balogh, Osann, Kramer, Dvorak, Genova & Traub

[57] ABSTRACT

A rolling mill comprises a pair of crown work rolls each having, at both ends of a drum, tapered ends ground at different taper angles, respectively. The work rolls are located one above the other with one tapered end of one work roll being in opposition to one tapered end having a different taper angle of the other work roll. The work rolls are movable in axial directions, such that edges of the plates are rolled by one tapered end of one work roll and a drum of the other work roll, and between tapered ends of both the work rolls. The method and rolling mills are capable of controlling the crown and edge drop reduction and simultaneously preventing local protrusions such as high spots and edge built-up to produce flat rolled plates having no difference in thickness and further capable of controlling the crown and the edge drop according to the material, thickness and width of the plates.

10 Claims, 11 Drawing Figures

Defect in Flatness

Crown = hc-(he1+he1')/2

Edge Drop = he1-he
or = he1'-he'

High Spot

Edge Built-up

ROLLED PLATE SECTIONAL PROFILE CONTROL ROLLING METHOD AND ROLLING MILL

BACKGROUND OF THE INVENTION

This invention relates to a method of controlling sectional profiles of plates such as steel plates to be rolled by means of two, four, five and six-high-mills in thick plate rolling, hot or cold plate rolling, and more particularly to a rolling mill including particularly constructed rolls for controlling sectional profiles of plates to be rolled.

As to configuration and quality of rolled products, it has been severely required to eliminate four defects, that is, (a) waved deformations resulting from waving phenomenon (problem in flatness), (b) crowns due to difference in thickness between edges and centers, (c) edge drops owing to metal flowing particularly occurring in edges and (d) local protrusions (high spots, edge build-ups, etc.).

In general, when a material is being rolled to reduce its thickness, sectional profiles of the material in width directions are determined by deformations of axes of work rolls, flattened deformations of the rolls and thermal crown and wear of the rolls caused in rolling. This is the reason why the control of sectional profiles of plate to be rolled is needed.

In order to uniformly control the above configuration and quality of rolled products, i.e. flatness and thickness profiles, various methods have been proposed such as roll bending method, rolling schedule changing method (Japanese Laid-open Patent Application No. 55-92,215), method of combination of six-high HC mill shifting method four-high work roll shifting method with roll bending method (Japanese Patent Application Publication No. 7,635/76) and method of combination of four-high work roll shifting method with working rolls having one tapered ground ends (Japanese Laid-open Patent Application No. 55-77,903).

In order to prevent the waving control the crown of the material and reduce the edge drops, there has been no effective method other than carefully carrying out the rolling operation from the cold rolling to the hot rolling. Although the roll bending method or apparatus has been mainly used and is effective to control the flatness of the material to a certain extent, it is hardly effective to control the crown or edge drop reduction. Moreover, the rolling schedule changing method is not effective to control the edge drop reduction, although it is effective to control the crown so as to make it constant.

In the six-high HC mill, intermediate rolls are shifted dependently upon widths of material to be rolled and the roll bending action is combined therewith. In this case, if the intermediate rolls are further shifted inwardly, excess surface pressure occurs on the surfaces of the rolls to cause spalling to an extent such that the further inward shifting of the intermediate rolls cannot be actually realized. Accordingly, the crown-controlling performance is decreased and not effective to reduce the edge drops. Moreover, the construction and reconstruction cost are expensive.

Work rolls having tapered ground ends, so-called "trapezoidal crown" rolls make it possible to control crowns and the control edge drop reduction. And such work rolls are effective to prevent the waving if a roll bending apparatus is combined, because it improves the controlling of the crowns and edge drop reduction. However, when widths of plates to be rolled change, the control effect correspondingly changes and local protrusions cannot be prevented.

Namely as the local protrusions such as high spots, edge built-ups and the like are due to extraordinary wear of work rolls which would occur at constant distances from edges of material in width directions, prevention of the local protrusions is difficult in rolling mills whose work rolls assume constant positions.

Particularly, as the edge built-ups are caused by the extraordinary wear occurring at edges of the material which contact the tapered ground ends of the work rolls and whose temperature is lower than that of its center, the edge built-up tend to occur when plates of the same width are continuously rolled. Accordingly, edge built-ups occur more considerably in rolling with trapezoidal crown rolls which are required to maintain widths of plates to be rolled at a substantially constant value, so that tapered ground ends of work rolls contact the material at substantially the same location of the material.

In using the trapezoidal crown rolls, the edge built-ups and edge drops tend to increase when the quality or hardness of the material to be rolled is changed.

In rolling by means of a rolling mill including work rolls having one tapered ground ends according to the four-high work roll shifting method, on the other hand, it is effective to control the crown and the edge drops. However, once the configuration of one tapered ground ends of work rolls has been determined, such a control is not necessarily satisfactory when the quality and thickness of the material to be rolled are changed. Particularly, the control of edge drop reduction is insufficient and required to be more improved.

SUMMARY OF THE INVENTION

It is an object of the invention to provide a rolling method and a rolling mill particularly for steel plates capable of controlling the crown and edge drop reduction and simultaneously preventing local protrusions such as high spots and edge built-ups to produce flat rolled plates having no difference in thickness and further capable of controlling the crown and the edge drop according to the material, thickness and width of the plates.

In general, in order to roll a steel plate having uniform thickness in width directions, it is important to keep uniform surfaces of work rolls in contact with the plate and to keep uniform a clearance between upper and lower work rolls in width directions.

It is therefore possible to produce rolled plates superior in flatness and sectional profiles in width directions by effecting the rolling operation fulfilling the above condition as possible. To this end, it is necessary to delete extra bending moment occurring at ends of drums of work rolls caused by back-up rolls in contact therewith to make small the deformation of roll axes. It is also necessary to mitigate the rapid change in flat deformation of the work roll at edges of the rolled plates to eliminate the metal flow in the edges and further to delete extraordinary wear locally occurring on the work rolls.

This invention enables the above functions to be applicable to steel plates having any widths.

The method of rolling plates in controlling sectional profiles of the plates according to the invention comprises arranging in a rolling mill a pair of work rolls each having tapered ends ground at different taper angles, respectively, and located one above the other with one tapered end of one work roll being in opposition to one tapered end having a different taper angle of the other work roll, and rolling the plates while the work rolls are moved in axial directions opposite to each other according to thicknesses, widths and materials of the plates such that edges of the plates are rolled by at least one tapered end of one work roll.

In an actual rolling operation, the edges of the plates are rolled between the one tapered end of one roll and a drum of the other roll and between tapered ends of both the work rolls.

A rolling mill according to the invention comprises a pair of crown work rolls each having, at both ends of a drum, tapered ends ground at different taper angles, respectively, and located one above the other with one tapered end of one work roll being in opposition to one tapered end having a different taper angle of the other work roll, said work rolls being movable in axial directions, back-up rolls for backing-up the work rolls, and a mill housing for housing the work rolls and the back-up rolls.

In a preferred embodiment of the invention the tapered ends of the work rolls are conical.

In carrying out the invention, a ratio of steep taper to gentle taper of said tapered ends is larger than one but not larger than ten.

The invention will be more fully understood by referring to the following detailed specification and claims taken in connection with the appended drawings.

Figure 3:
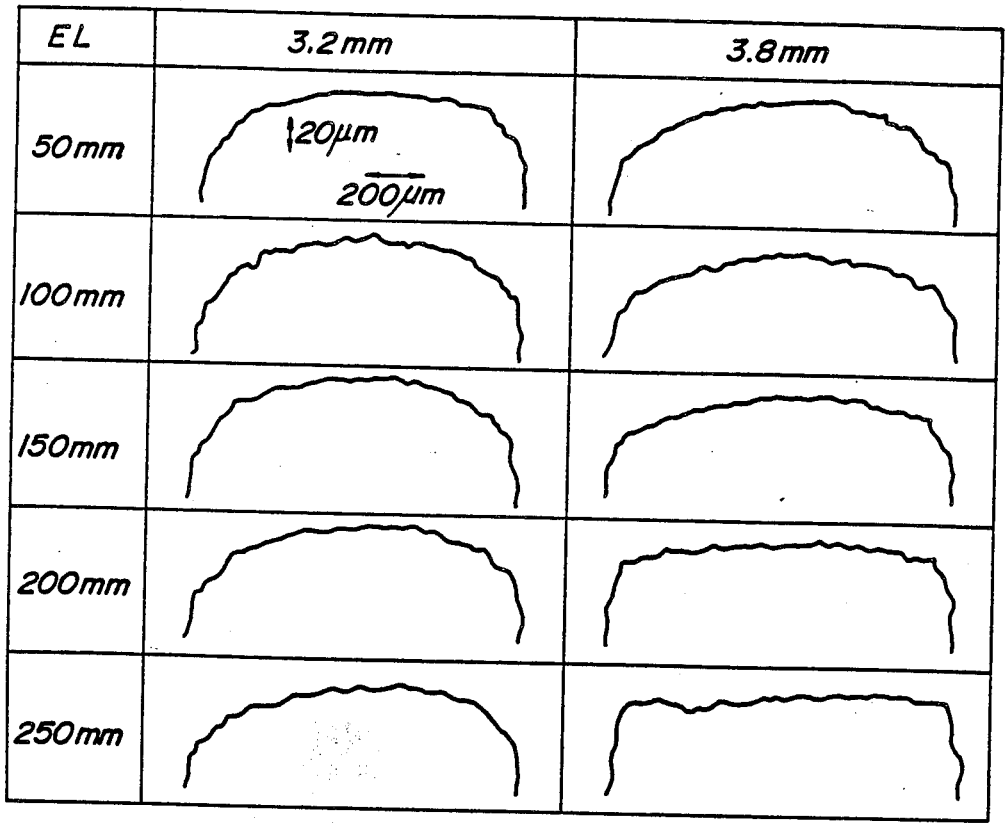
FIG. 3 PRIOR ART
Figure 3:
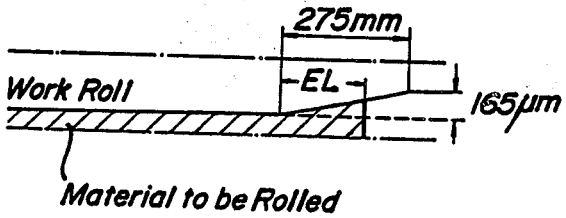
FIG. 3 PRIOR ART
Figure 4A:
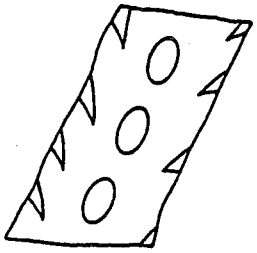
FIG 4a PRIOR ART
Figure 4B:
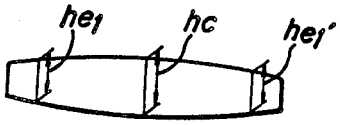
FIG 4b PRIOR ART
Figure 4C:
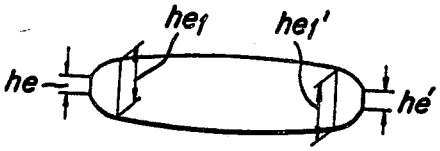
Figure 4D:
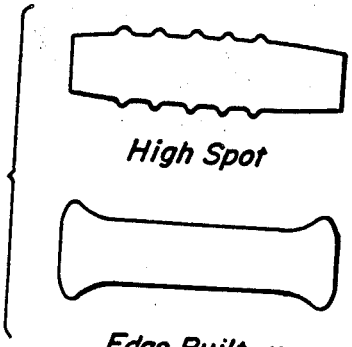
Figure 5:
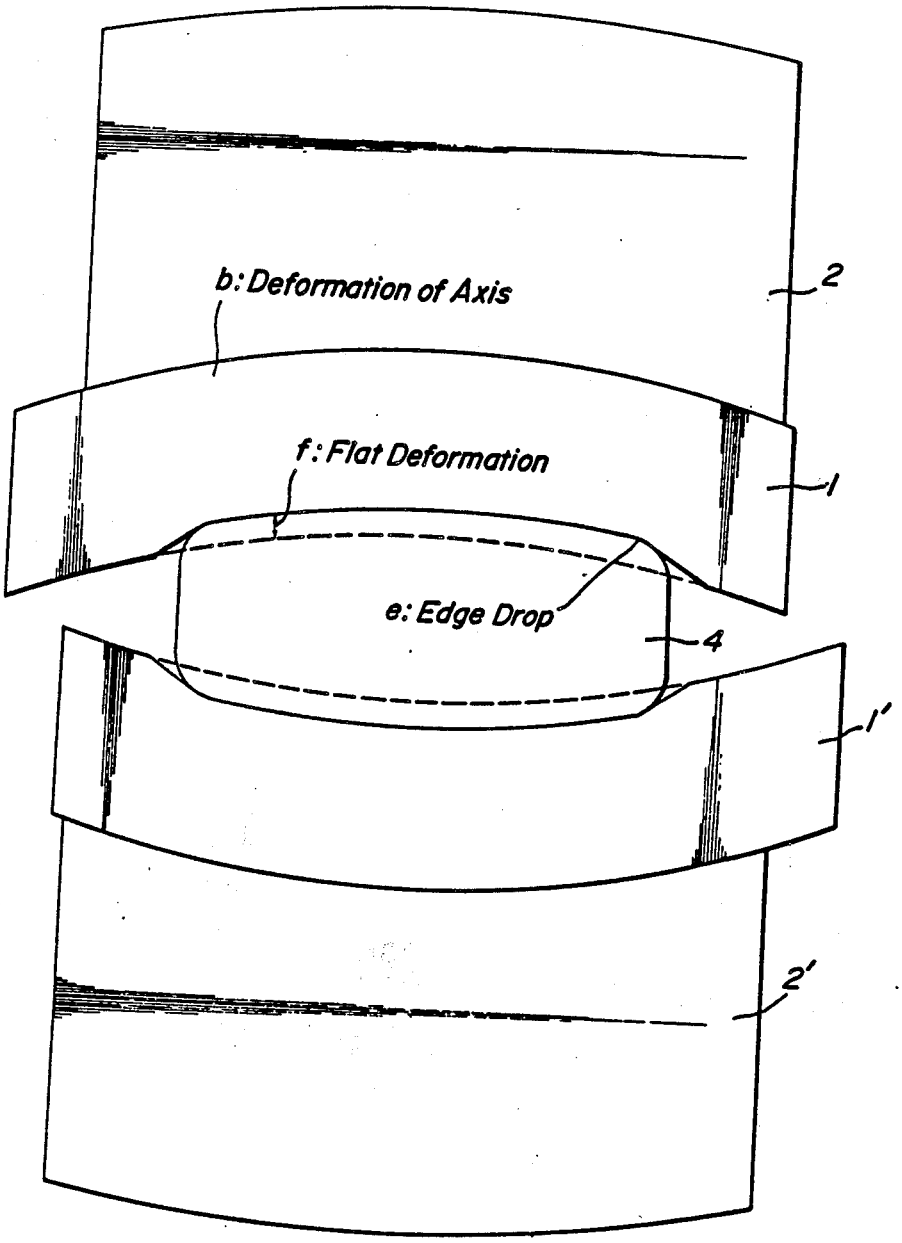
FIG 5 PRIOR ART
Figure 6:
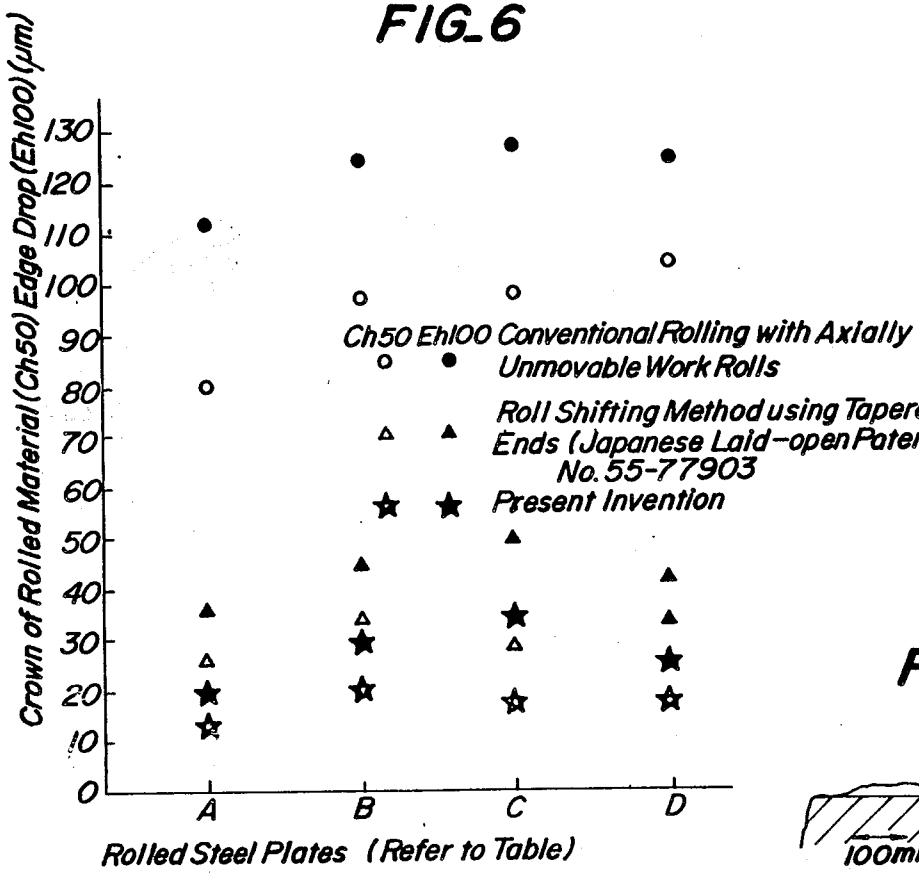
Figure 7:
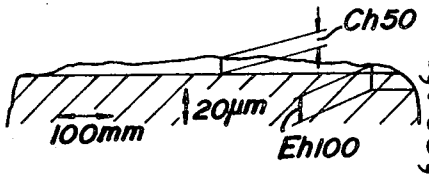

FIGS. *2a* and *2b* are schematic views for explaining the control of crowns and edge drops according to the invention;

FIG. 3 illustrates examples of profiles of rolled plates rolled by the work shifting method using one tapered ground ends of work rolls;

FIGS. *4a–4d* illustrate defects in shape and quality of rolled products;

FIG. 5 is a schematic view illustrating the elastic deformation of work rolls and sectional profiles of material to be rolled;

FIG. 6 is a graph illustrating the reduction of crown and edge drop according to the invention; and FIG. 7 is a schematic view illustrating a sectional profile of a product rolled according to the invention.

DESCRIPTION OF THE PREFERRED EMBODIMENTS

Figure 1:
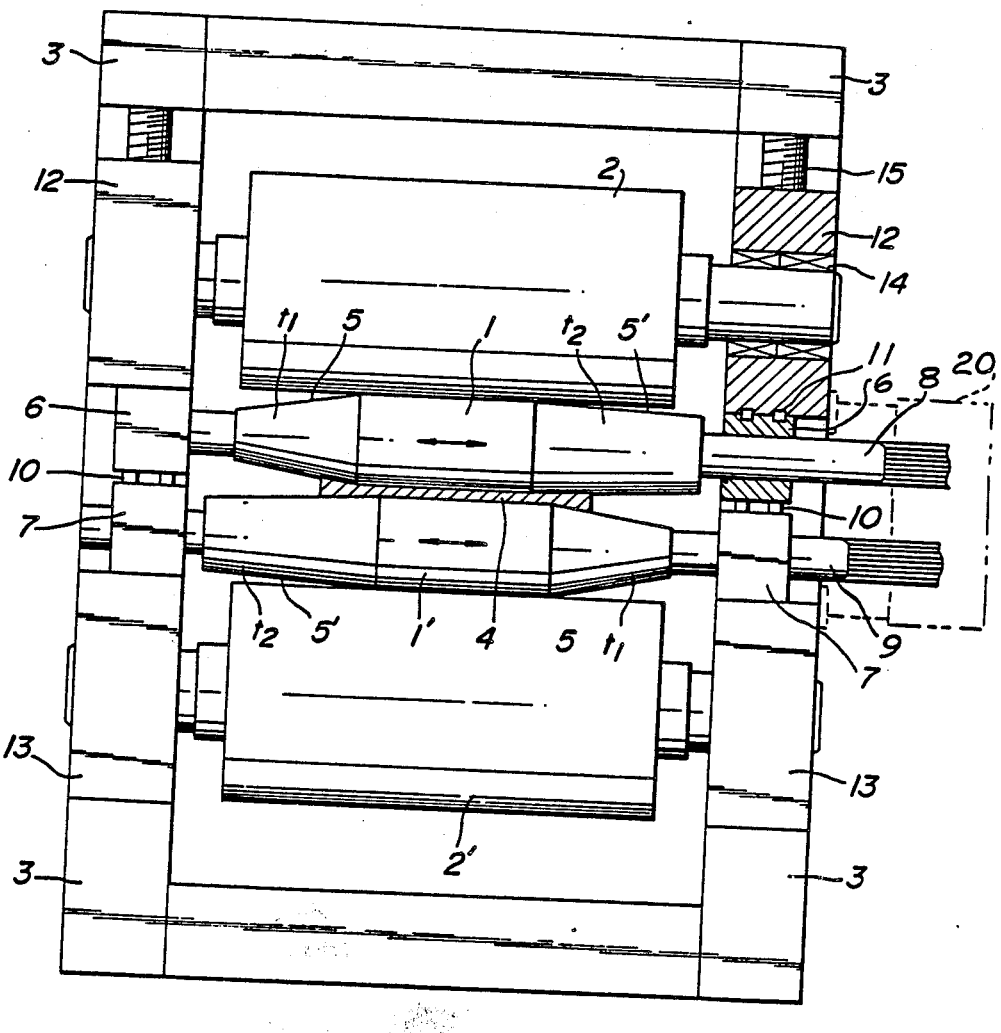
FIG. 1 is a schematic view of a four-high rolling mill to which the present invention is applied.

FIG. 1 illustrates a four-high rolling mill to which the present invention is applied. This rolling mill comprises work rolls 1 and 1', back-up rolls 2 and 2' and a mill housing 3 for rolling a material 4. Each the work roll 1 or 1' has tapered ends which are ground. One tapered end $t_1$ is steeper than the other tapered end $t_2$. These work rolls 1 and 1' are incorporated in the mill such that tapered ends different in tapered angle are arranged one above the other and the work rolls are shiftable in axial directions relative to the mill housing 3 as shown by arrows in FIG. 1.

The work rolls 1 and 1' have the ground surfaces 5 and 5' on the tapered ends and supported in bearing chocks 6 and 7, respectively. The work rolls 1 and 1' further have spindles 8 and 9 which are splined for torque transmission.

Work roll shifting means 20 for moving the upper and lower work rolls 1 and 1' in their axial directions may be arranged in the proximities of the bearing chocks 6 and 7 or at extended ends of the spindle 8 and 9. Driving system of the driving means may be hydraulic, electrical or magnetical.

A reference numeral 10 denotes balancing or roll bending device for increasing the bending action acting upon the work rolls 1 and 1'. A numeral 11 denotes roll bending device for decreasing the bending action. The back-up rolls are supported by chocks 12 and 13 including bearings 14 and urged downwardly by screws 15.

Although the work rolls are driven in this embodiment, the back-up rolls may be driven. Moreover, although the steeper tapered end of the upper work roll is on the right side as viewed in FIG. 4, it may be on the left side.

FIG. 3 illustrates typical profiles of rolled materials rolled in a four-high rolling mill including work rolls having one tapered ground ends according to the work roll shifting. As can be seen from FIG. 3, thicknesses of edges of the rolled materials considerably decrease. This variation in thickness is not linear. Moreover, the profiles of the thickness are greatly different depending upon the thicknesses of the finished plates.

If the quality and thickness of material to be rolled are changed, the shapes of edge drops are also changed. In view of the results of FIG. 3, in order to effect complete crown and edge drop controls, it is required to prepare a plurality of profiles of tapered ends of work rolls subjected to the roll shifting for the purpose of dealing with complicated change of thickness of the material in the proximities of its edges.

As shown in FIG. *2b*, according to the invention, work rolls 1 and 1' have steep tapered ends and gentle tapered ends, so that the following controls can be effected dependently upon shifted distances of the work rolls as shown in FIG. *2b* in the order from the top to the bottom. They are the control of the crown and edge drop by means of (1) only the gentle tapered portions $t_2$, (2) the gentle and steep tapered portions $t_2$ and $t_1$ (with hard and thick materials which tend to considerably decrease their thickness at edges), and (3) only the steep tapered portions $t_1$.

The control of the crown and edge drop is effected by means of (1) only the gentle tapered portions $t_2$, which is shown in the uppermost combination of the work rolls and the material in the FIG. *2b*. The edges of the material 4 are rolled between the gentle tapered portion $t_2$ of the upper work roll and the straight drum of the lower work roll and between the straight drum of the upper work roll and the gentle tapered portion $t_2$ of the lower work roll.

The control of crown and edge drop of hard and thick materials which tend to considerably decrease their thickness at edges is effected by means of (2) the gentle and steep tapered portions $t_2$ and $t_1$, which is shown in the second, third and fourth combinations from the top in FIG. *2b*.

The control of crown and edge drop is effected by means of (3) only the steep tapered portions $t_1$, which is shown in the lowermost combination of the work rolls and the material in FIG. *2b*.

In other words, by adjusting the shifted distances of the work rolls according to the quality, thicknesses and widths of the material to be rolled, effective control of the crown and edge drop can be carried out.

According to the invention, ends of work rolls are ground into different tapered ends and the work rolls are arranged with their different tapered ends being alternately arranged, so that contact pressure of the work rolls at their drum ends with back-up rolls becomes small without any extra bending moment acting upon the work rolls, with the result that the deformations of axes of the work rolls decrease to ensure the prevention of the waving and the control of crown.

Moreover, the upper and lower work rolls 1 and 1' are moved reversely relative to each other according to the thickness, width and quality of the material 4 to be rolled so that edges of the material are located at the one tapered ground end or both the tapered ground ends. Accordingly, the contact pressure of the work rolls 1 and 1' with edges of the material to be rolled decreases to mitigate the rapid change in deformation of work rolls tending to flatten at edges of the material, so that particular metal flow of the material at its edges is eliminated to effectively control the edge drop.

Moreover, the upper and lower work rolls 1 and 1' can be moved in the axial directions, so that the extraordinary local wear is also mitigated which would otherwise occur in conventional work rolls, and the local protusions are also effectively eliminated.

In other words, even if the extraordinary local wear occurs on the roll surfaces, the work rolls are moved in axial directions to distribute the wear all over the straight ground surfaces of the work rolls, so that the high spots caused by the straight ground surfaces can be effectively mitigated. Moreover, as can be seen from an embodiment later described, the contact position of the material with the tapered ground ends need not be limited to one point and has an allowable range. Accordingly, the edge built-up can be effectively prevented by changing the contact position of the material within the allowable range (for example, −50 to +50 mm).

When the quality of the material 4 is changed, for example, from hard to soft one, the edge drop and the edge built-up can be effectively prevented by finely adjusting shifted distances of the work rolls in a manner making small the length of edges of the material to be rolled by ground surfaces in addition to the adjustment for change in width of the material. A ratio of the gentle tapered angle to the steep tapered angle should be determined dependently upon quality, thickness and width of the material in the same rolling cycle. From the typical profiles shown in FIG. 3, the following relation in desirable.

$$1 < \text{the steep taper/the gentle taper} \leqq 10$$

Moreover, the length of the tapered ground portions of the work rolls 1 and 1' in the axial directions is preferably 2–500 mm.

FIGS. 4*a*–4*d* illustrate (a) the defect in flatness due to waving phenomenon, (b) the crown resulting from difference in thickness between edges and centers, (c) edge drop owing to particular metal flowing at edges, and (d) the high spot and the edge built-up due to the local wear of work rolls. FIG. 5 illustrates (b) the deformation of the roll axis, (f) the flat deformation and (e) the edge drop due to these deformations.

TABLE 1

| | Kind of steel | Width (mm) | Thickness on entry side (mm) | Thickness on delivery side (mm) | EL EL1 (mm) | EL EL2 (mm) | EH EH1 (μm) | EH EH2 (μm) |
|---|---|---|---|---|---|---|---|---|
| A | Low carbon steel | 800 | 4.5 | 3.2 | 150 | 50 | 150 | 100 |
| B | Low carbon steel | 1,000 | 4.5 | 3.2 | 250 | 100 | 250 | 200 |
| C | Low carbon steel | 800 | 4.5 | 3.8 | 200 | 75 | 200 | 150 |
| D | High carbon steel | 800 | 4.5 | 3.2 | 200 | 100 | 250 | 200 |
| | | | Steep taper/Gentle taper = 2 | | | | | |

Figure 2A:
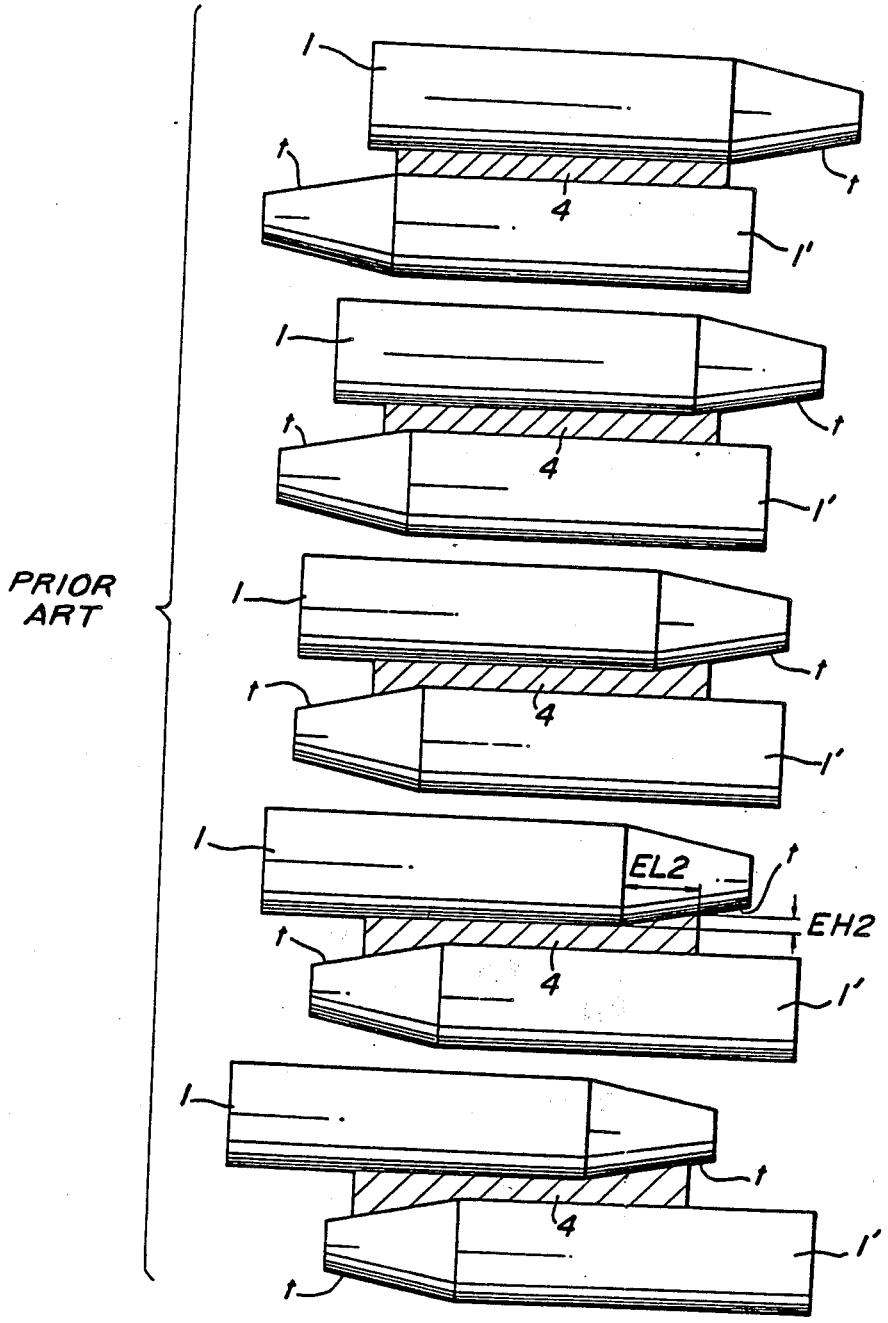
Figure 2B:
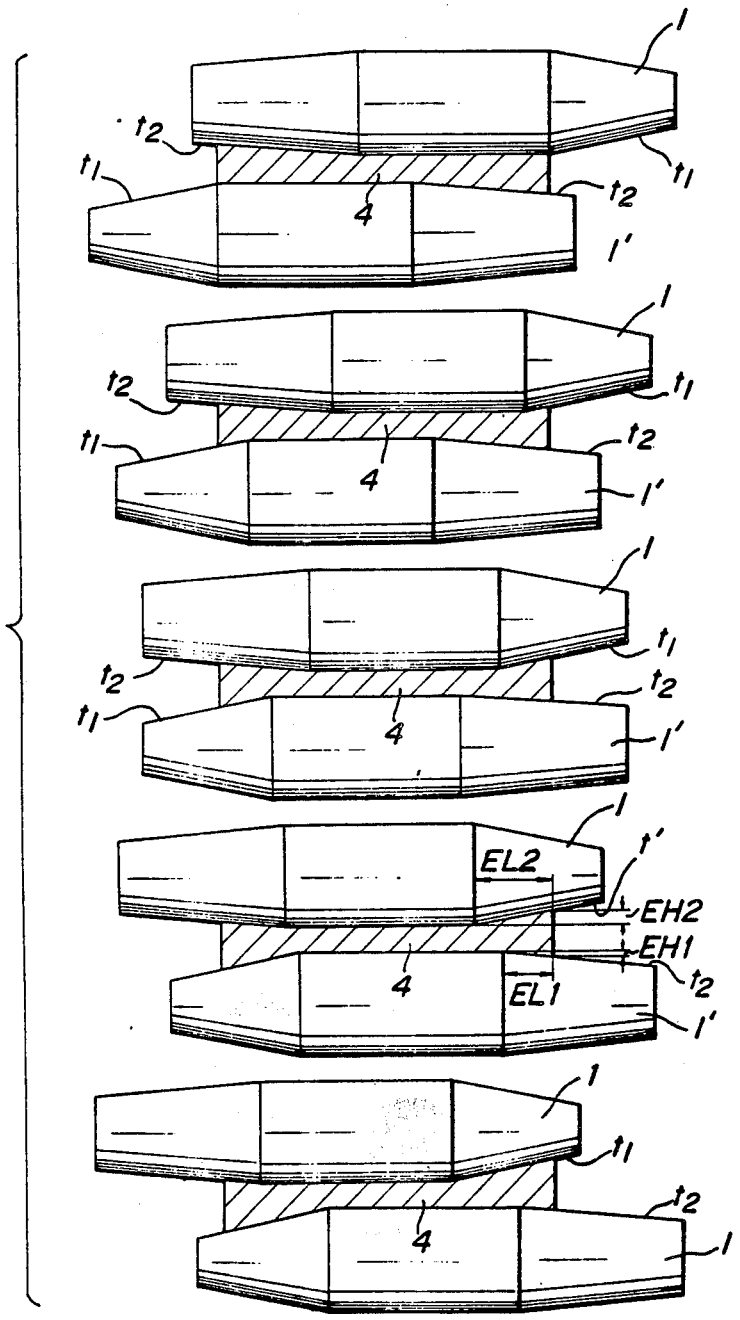

Four kinds of steels are hot-rolled by three rolling methods, the conventional rolling method using axially fixed work rolls, work roll shifting method using work rolls having one tapered ground ends and the rolling method according to the invention using the rolling mill of the invention. Positional relations between the work rolls and the material to be rolled are indicated by EL and EH which are defined as shown in FIGS. 2*a* and 2*b*.

$$\text{Crowns}\left(Ch_{50} = \frac{hc - h_{50}}{2}\right) \text{ and}$$

$$\text{edge drops}\left(Eh_{100} = \frac{h_{100} - h_{10}}{2}\right)$$

of the rolled products are shown in FIG. 6 in comparison of the present invention with the prior art.

In this case, hc is thicknesses of the material 4 at the middle of the width and $h_{100}$ is thicknesses of the material at locations 100 mm spaced from edges of the material. Moreover, $h_{50}$ and $h_{10}$ are thicknesses at locations 50 mm and 100 mm spaced from edges of the material, respectively. FIG. 7 illustrates a profile of the thickness of the A material (low carbon steel, 800 mm width and 3.2 mm thickness on the delivery side) rolled by the method according to the invention.

As can be seen from FIGS. 6 and 7, the crowns and edge drops of the products rolled according to the invention are smaller than those rolled by the prior art. Moreover, according to the invention, the rolled products have preferable profiles without any high spot and edge built-up. The shown tapered ends of work rolls are conical, but they may be sine curved or arcuate. Furthermore, the present invention can control the flatness of rolled plates with the aid of a roll bending apparatus.

As can be seen from the above description, the present invention is very effective to control the crown, the edge drop reduction, and prevention of local protrusions and applicable to two, four, five and six-high rolling mills and cluster mills including slabbing and series of roughing and finishing mills for hot and cold rolling. Moreover, the application of the invention and the reconstruction of existing mills therefor are simple and easy, so that the cost of installation is advantageously inexpensive.

As the uniform wear of work rolls can be achieved, the number of rolled coils per one rolling cycle can be increased. Moreover, the schedule for rolling the materials having various widths is not limited, so that the working efficiency can be remarkably improved and the service period of the rolls to be used can be considerably prolonged.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A method of rolling plates in controlling sectional profiles of said plates comprising arranging in a rolling mill a pair of work rolls each having a drum ending in tapered ends ground in steep and gentle tapers, respectively, and located one above the other with one tapered end of one work roll being in opposition to one tapered end having a different taper angle of the other work roll, and rolling the plates when the work rolls are moved or shifted in axial directions opposite to each other according to thicknesses, widths, and materials of the plates such that edges of the plates are rolled by at least one tapered end of one work roll, said shifting of the work rolls taking place before rolling at least one plate and during rolling of the plates.

2. A method of rolling plates as set forth in claim 1, further comprising shifting the position of one work roll so that its drum overlies one of the tapered ends of the other work roll, wherein said edges of the plates are rolled by one tapered end of one work roll and a drum of the other work roll.

3. A method of rolling plates as set forth in claim 1, providing work rolls having conical tapered ends.

4. A method of rolling plates as set forth in claim 1, further comprising providing work rolls having a ratio of steep taper to gentle taper of said tapered ends larger than one but not larger than ten.

5. A method of rolling plates as set forth in claim 1, further comprising rolling the plates after the work rolls are moved or shifted in axial directions opposite to each other, said shifting of the work rolls taking plate before rolling at least one plate.

6. A method of rolling plates as set forth in claim 1, further comprising rolling the plates while the work rolls are moved or shifted in axial directions opposite to each other, said shifting of the work rolls taking place during rolling of the plates.

7. A method of rolling plates as set forth in claim 1, further comprising shifting the position of one work roll relative to the other work roll, so that said edges of the plates are rolled by tapered ends of both the work rolls.

8. A rolling mill comprising a pair of crown work rolls each having, at both ends of a drum, tapered ends ground at different taper angles, respectively, and located one above the other with one tapered end of one work roll being in opposition to one tapered end having a different taper angle of the other work roll, work roll shifting means for shifting said work rolls in axial directions, back-up rolls for backing-up the work rolls, and a mill housing for housing said work rolls and said back-up rolls.

9. A rolling mill as set forth in claim 8, wherein said tapered ends of the work rolls are conical.

10. A rolling mill as set forth in claim 8, wherein a ratio of steep taper to gentle taper of said tapered ends is larger than one but not larger than ten.

* * * * *